US006922124B2

(12) United States Patent
Segi et al.

(10) Patent No.: US 6,922,124 B2
(45) Date of Patent: Jul. 26, 2005

(54) ELECTROMAGNETIC DRIVE DEVICE

(75) Inventors: Masaya Segi, Okazaki (JP); Mikio Suzuki, Hekinan (JP); Koichi Takanishi, Nishio (JP); Masaru Suzuki, Chiryu (JP); Yoshinori Kaneda, Okazaki (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/781,716

(22) Filed: Feb. 20, 2004

(65) Prior Publication Data

US 2004/0164640 A1 Aug. 26, 2004

(30) Foreign Application Priority Data

Feb. 21, 2003 (JP) ..... 2003-044940

(51) Int. Cl.[7] ..... H01F 7/08
(52) U.S. Cl. ..... 335/220; 335/281; 251/129.15
(58) Field of Search ..... 335/256, 281–282, 335/220–229, 296; 251/129.1–129.15

(56) References Cited

U.S. PATENT DOCUMENTS

| | | | | |
|---|---|---|---|---|
| 4,486,053 | A | 12/1984 | Hawker et al. | |
| 6,420,949 | B1 * | 7/2002 | Umemoto et al. | 335/251 |
| 6,588,093 | B1 | 7/2003 | Emmerich et al. | |
| 6,601,822 | B2 | 8/2003 | Tachibana et al. | |
| 2003/0168619 | A1 * | 9/2003 | Jansen | 251/129.07 |

FOREIGN PATENT DOCUMENTS

| | | |
|---|---|---|
| EP | 0 133 858 | 3/1985 |
| EP | 1 134 471 | 9/2001 |
| JP | 1-242884 | 9/1989 |
| WO | WO 99/16092 | 4/1999 |

OTHER PUBLICATIONS

"Materia Japan", vol. 36, No. 4(1997), pp. 358–360.

* cited by examiner

*Primary Examiner*—Lincoln Donovan
(74) *Attorney, Agent, or Firm*—Oblon, Spivak, McClelland, Maier & Neustadt, P.C.

(57) ABSTRACT

An electromagnetic drive device for lineally reciprocatilvely moving an operating member like a spool of a spool valve is reduced in the manufacturing cost without being degraded in its operational performance. In the electromagnetic drive device, a stator body is excited by an electromagnetic coil to axially move a plunger guided in an inner bore of the stator body, against the resilient force of a spring. The stator body is constituted by arranging a plurality of core portion annular plate elements made of a magnetic material, a plurality of yoke portion annular plate elements made of a magnetic material and a plurality of non-magnetic portion annular plate elements made of a non-magnetic material and placed between the core portion annular plate elements and the yoke portion annular plate elements and by piling up and bodily joining these annular plate elements in axial alignment with one another. Each of the annular plate elements is provided with plural embossed portions each of which is half-blanked to be prominent at one surface side and hollow at the other surface side. The embossed portions formed on each annular plate element are fit at the prominent surface sides thereof respectively in the hollow surface sides of the embossed portions formed on another annular plate element, so that all the annular plate elements can be bodily joined in axial alignment with one another.

5 Claims, 2 Drawing Sheets

ELECTROMAGNETIC DRIVE DEVICE

INCORPORATION BY REFERENCE

This application is based on and claims priority under 35 U.S.C. sctn. 119 with respect to Japanese Application No. 2003-044940 filed on Feb. 21, 2003, the entire content of which is incorporated herein by reference.

BACKGROUND OF THE INVENTION

1. Field of the Invention

The present invention relates to an electromagnetic drive device for linearly reciprocatilvely moving an operating member such as, for example, a spool of a spool valve.

2. Discussion of the Related Art

Heretofore, as electromagnetic drive device for reciprocatively moving a spool of a spool valve, there has been known one described in Japanese unexamined, published patent application No. 1-242884 (1989-242884). In the known electromagnetic drive device, a first solenoid housing (i.e., core) and a second solenoid housing (i.e., yoke) both made of a magnetic material are arranged serially in axial alignment with a non-magnetic portion (i.e., air gap or non-magnetic member) placed therebetween, thereby to constitute a stator, and a plunger is slidably guided in an inner bore formed in the stator. By exciting the solenoid housings with a solenoid, the plunger is axially moved against a spring, so that a spool in a spool or valve housing attached to the first solenoid housing (i.e., core) is operated. Where the plunger is slidably received in the inner bore of the stator in this manner, a strict alignment is required between the internal surfaces of the yoke and the core. Therefore, it is necessary to machine the internal surfaces of the yoke and the core after they are inserted into and secured to a sleeve made of a non-magnetic material.

Further, there has also been known a technology described in U.S. Pat. No. 6,601,822 B2 to S. Tachibana et al. In this known technology, a stator for slidably guiding a plunger is constituted as a cylindrical stationary core which is made as one piece of a magnetic material, and a thin annular portion is formed by partly cutting out the outer wall portion at the axial mid position of the stationary core radially facing the plunger to the extent that the mechanical strength thereat is not deteriorated. A plurality of radial through holes are formed in the thin annular portion to decrease the area for magnetic path and thereby to increase the magnetic resistance thereat so that a portion equivalent to a non-magnetic portion can be formed at the thin annular portion.

Further, there is known a technology described in a technical journal "Materia Japan", vol. 36, No. 4 (1997), pages 358–360. In this technology, a non-magnetic pipe made of a quasi-austenite base stainless steel is first converted by a cold roll process into a magnetic pipe, which is then partly processed by a selective quenching, whereby a magnetic stator with a non-magnetic portion at its axial mid portion can be made.

However, in the technology described in the aforementioned Japanese application, problems are raised in that the number of parts constituting the electromagnetic drive device increases and that many steps are needed for the machining of the fitting portions, press-fittings, and the finish machining of the inner bore for the plunger after the press-fittings, thereby resulting in an increase of the manufacturing cost. On the other hand, the problem of an increase in the manufacturing cost can be solved in the technology described in the aforementioned United States patent. That is, in the second technology, the annular portion is made thin and is provided with the plural radial through holes thereby to increase the magnetic resistance thereat. However, since it is unavoidable that the magnetic flux leaks through the annular portion, there is raised another problem that the magnetic attraction force exerted on the plunger is weakened. Further, the last mentioned technology for partly processing the magnetically converted stainless steel pipe by a selective quenching process needs plural steps of special processing, which undesirably results in an increase in the manufacturing cost.

SUMMARY OF THE INVENTION

Accordingly, it is a primary object of the present invention to provide an improved electromagnetic drive device whose stator body is constituted by piling up or laminating in axial alignment a plurality of annular plate elements which can be formed by press-forming of a high productivity.

Briefly, according to the present invention, there is provided an electromagnetic drive device having a stator body composed of a core portion and a yoke portion serially arranged in axial alignment with a non-magnetic portion placed therebetween, a plunger slidably received in an inner bore formed in at least one of the yoke portion and the core portion in the stator body and resiliently urged in one direction, and an electromagnetic coil for exciting the stator body to move the plunger in the axial direction thereof against the resilient force. The stator body is constituted by piling up in axial alignment and bodily joining a plurality of core portion annular plate elements made of a magnetic material to form the core portion, a plurality of yoke portion annular plate elements made of a magnetic material to form the yoke portion, and a plurality of non-magnetic portion annular plate elements made of a non-magnetic material to form the non-magnetic portion.

With this configuration, the plurality of annular plate elements constituting the stator body are obtained by being punched or blanked out by a press from a plate member and therefore are at a low cost. Further, the non-magnetic portion placed between the core portion and the yoke portion each made of a magnetic material can be formed easily and completely only by placing and piling up the plural non-magnetic portion plate elements between the plural core portion plate elements made of a magnetic material and the plural yoke portion plate elements made of a magnetic material, so that the magnetic leakage of magnetic flux from one of the yoke portion and the core portion to the other can be prevented. Accordingly, since the cost can be reduced in manufacturing the stator body having the core portion and the yoke portion which are serially arranged in axial alignment with the non-magnetic portion placed therebetween, the manufacturing cost for the electromagnetic drive device can be reduced, and it does not occur that the magnetic attraction force exerted on the plunger is weakened due to the leakage of the magnetic flux from one of the yoke portion and the core portion to the other.

BRIEF DESCRIPTION OF THE ACCOMPANYING DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENTS

Hereinafter, an electromagnetic drive device in the first embodiment according to the present invention will be described with reference to FIGS. 1 to 5. In this particular embodiment, the present invention is applied to a solenoid-operated valve, and an electromagnetic drive device 10 of the solenoid-operated valve in the embodiment is designed to linearly reciprocate a spool (operating member) 24 of a valve section (operating device) 20 which is provided in axial alignment therewith.

Figure 1:
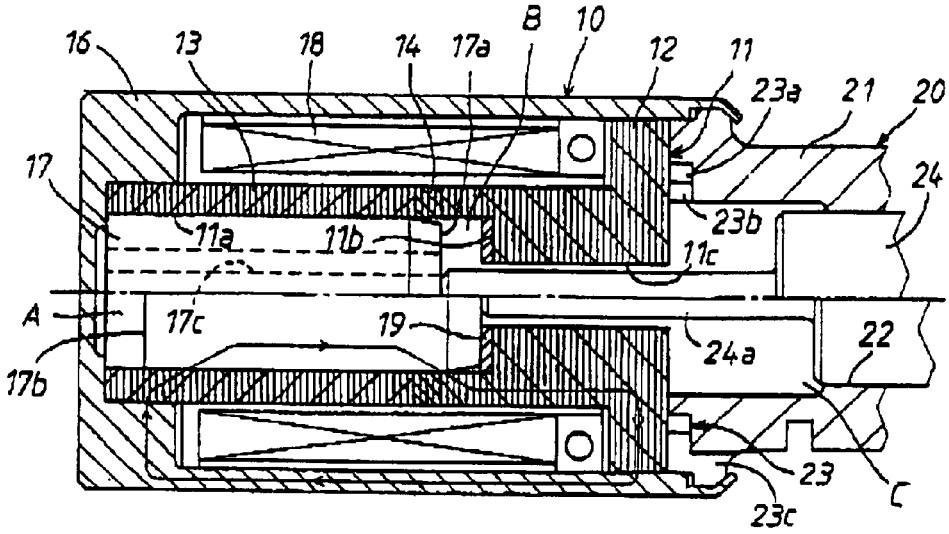
FIG. 1 is a longitudinal sectional view showing the general construction of an electromagnetic drive device in the first embodiment according to the present invention.
Figure 2:
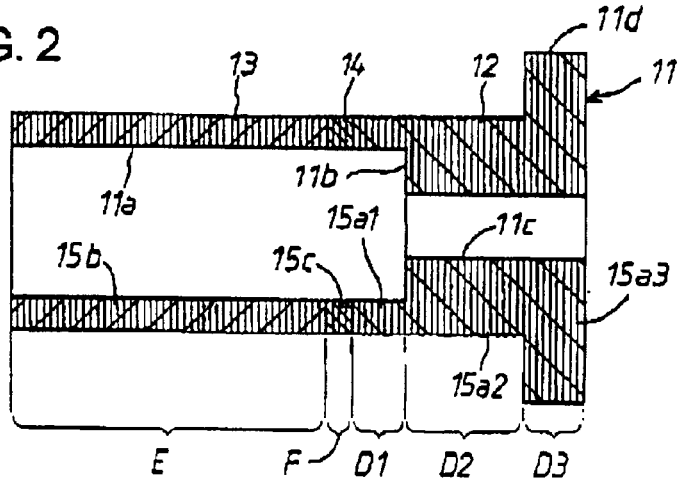
FIG. 2 is a sectional view of a stator body in the first embodiment shown in FIG. 1.

As shown primarily in FIGS. 1 and 2, the electromagnetic drive device 10 is composed of a stator body 11 which is constituted by piling up or laminating and bodily joining a plurality of annular plate elements 15*a*1 through 15*a*3, 15*b*, 15*c* in axial alignment, a cover 16 made of a magnetic material which covers the stator body 11 thereby to connect the axial opposite ends of the same magnetically with each other, a plunger 17 and an electromagnetic coil 18. The stator body 11 is composed of a core portion 12 and a yoke portion 13 which are serially arranged in axial alignment with a non-magnetic portion 14 provided therebetween. With respect to the outer shape thereof, the stator body 11 extends in a predetermined diameter from the rear end of the yoke portion 13 through the non-magnetic portion 14 up to the portion close to the forward end portion of the core portion 12, and a flange portion 11*d* is formed at the forward end portion of the core portion 12. Further, in the stator body 11, an inner bore 11*a* of another predetermined diameter is formed to extend from the rear end of the yoke portion 13 through the non-magnetic portion 14 up to the axial mid position of the core portion 12 in coaxial alignment with the axis of the stator bore 11, and a center hole 11*c* which is smaller in diameter than the inner bore 11*a* is formed from the axial mid position up to the forward end of the core portion 12 in axial alignment with the inner bore 11*a*.

The plunger 17 is made of a magnetic material in its entirety and is guided and supported slidably in the inner bore 11*a* of the stator body 11. The plunger 17 is movable between an advanced position (shown at the lower half in FIG. 1) where its forward end surface 17*a* at the side of the valve section 20 abuts on an inner end surface of the inner bore 11*a* through a washer 19, and a retracted position (shown at the upper half in FIG. 1) where its rear end surface 17*b* abuts on the inner bottom surface of the cover 16. In the inner bore 11*a*, an electromagnetic section fluid chamber (B) is defined between the forward end surface 17*a* of the plunger 17 and the inner bore 11*a* of the stator body 11, while a rear end fluid chamber (A) is defined between the rear end surface 17*b* of the plunger 17 and the inner bottom surface of the cover 16. The rear end fluid chamber (A) and the electromagnetic section fluid chamber (B) are in communication with each other through a communication hole 17*c* which is formed in the plunger 17 to pass through axially of the same.

The valve section 20 is composed of a valve sleeve 21 and the aforementioned spool 24 slidably received in a valve hole 22 which is formed coaxially in the valve sleeve 21. The valve sleeve 21 is secured to the stator body 11 in axial alignment therewith by caulking the opening end portion of the cover 16 with its flange portion at the rear end portion being in abutting contact with the flange portion at the forward end portion of the stator body 11. The spool 24 is resiliently urged toward the electromagnetic drive section 10 by means of a spring (not shown), which is interposed between itself and a plug member (not shown) screwed into a forward end portion (not shown) of the valve sleeve 21. A rod portion 24*a* which is formed to protrude from the rear end of the spool 24 extends passing through the center hole 11*c* of the stator body 11 and abuts on the forward end surface 17*a* of the plunger 17. Thus, in the inoperative state, the plunger 17 is kept at the aforementioned retracted position where the rear end surface 17*b* thereof abuts on the inner bottom surface of the cover 16. An intermediate fluid chamber (C) formed at the mid position between the stator body 11 and the valve sleeve 21 communicates, on one hand, with the electromagnetic section fluid chamber (B) through an annular clearance which is formed between the center hole 11*c* of the stator body 11 and the rod portion 24*a* of the spool 24 and, on the other hand, with the external of the solenoid-operated valve through a labyrinth supply/drain passage 23 composed of an annular groove 23*a* and cutouts 23*b*, 23*c*.

As shown in FIGS. 1 and 2, the stator body 11 is composed of the core portion 12 and the yoke portion 13 which are arranged serially in axial alignment with each other with the non-magnetic portion 14 placed therebetween. Each of the core portion 12, the yoke portion 13 and the non-magnetic portion 14 is constituted by piling up or laminating in axial alignment and bodily joining a plurality of annular plate elements 15 which are formed by being punched or blanked out from a thin metal plate of the thickness of e.g., 0.5 millimeter.

Figure 3:
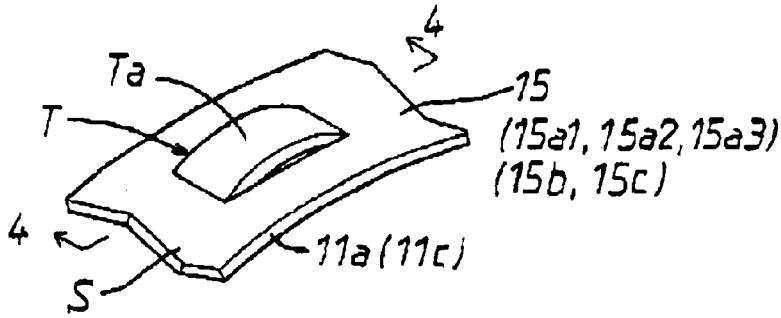
FIG. 3 is an enlarged, fragmentary perspective view of one of embossed portions formed on each of annular plate elements of the stator body for joining the annular plate elements with one another.
Figure 4:
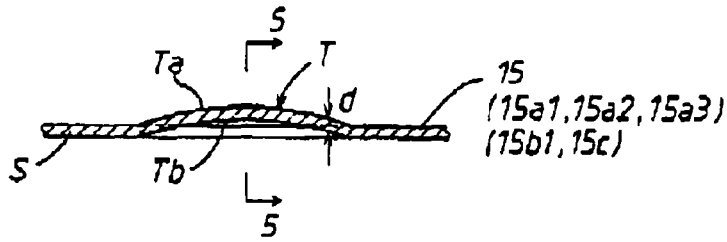
FIG. 4 is a sectional view of the embossed portion taken along the line 4—4 in FIG. 3.
Figure 5:
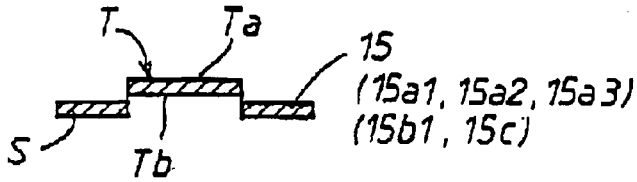
FIG. 5 is a sectional view of the embossed portion taken along the line 5—5 in FIG. 4.

The non-magnetic portion 14 denoted as a zone (F) in FIG. 2 is constituted by piling up a plurality of non-magnetic portion annular plate elements 15*c* made of a non-magnetic material (e.g., austenite-base stainless steel) one after another. The inner and outer diameters of each non-magnetic portion annular plate element 15*c* coincide respectively with the diameter of the inner bore 11*a* and the outer diameter of the portion of the stator body 11 excepting for the flange portion 11*d*. As shown in FIGS. 3 to 5, at three positions circumferentially spaced at equiangular intervals on an annular body portion (S) thereof, each non-magnetic portion annular plate element 15*c* is provided with embossed portions (T) which are formed by half-blanking each to take an arc shape of a predetermined width. The thickness (d) between the front surface (Ta) and the reverse surface (Tb) of each embossed portion (T) in a direction normal to the surface of the body portion (S) is almost the same as the thickness of the body portion (S). The half-blanking for the embossed portions (T) can be performed simultaneously of blanking or punching out the body portion (S). The prominent front surfaces (Ta) of the embossed portions (T) formed on each non-magnetic portion annular plate element 15*c* are respectively fit in the corresponding hollow reverse surfaces (Tb) of the embossed portion (T) formed on another non-magnetic portion annular plate element 15*c* which is to be piled thereon, so that all the non-magnetic portion annular plate elements 15*c* are joined bodily in axial alignment thereby to form the non-magnetic portion 14.

The yoke portion 13 denoted as a zone (E) in FIG. 2 is constituted by piling up or laminating a plurality (larger in number than the non-magnetic portion annular plate elements 15*c*) of yoke portion annular plate elements 15*b* made of a magnetic material (e.g., cold rolled steel plate desirably of a high fineness) one after another. The shape and dimension of each yoke portion annular plate element 15*b* are the same as those of each non-magnetic portion annular plate element 15*c*. In the same manner as the non-magnetic portion annular plate elements 15*c*, each yoke portion annular plate element 15*b* is piled or laminated on another yoke portion annular plate element 15*b* with the prominent front surfaces (Ta) of the embossed portions (T) on one element (15*b*) being respectively fit in the hollow reverse surfaces (Tb) of those on another element (15*b*), so that all the yoke portion annular plate elements 15*b* are joined bodily in axial alignment thereby to form the yoke portion 13. Further, the prominent front surfaces (Ta) or the hollow reverse surfaces (Tb) of the annular plate element 15*b* of the yoke portion 13 which element is closest to the side of the non-magnetic portion 14 is fit in the hollow reverse surface (Tb) or the prominent upper surface (Ta) of the annular plate element 15*c* of the non-magnetic portion 14 which element is closest to the side of the yoke portion 13, so that the yoke portion 13 and the non-magnetic portion 14 are joined bodily in axial alignment.

As shown in FIG. 2, the core portion 12 is partitioned into three (i.e., first to third) zones D1, D2 and D3, and each of core portion annular plate elements 15*a*1, 15*a*2 and 15*a*3 in the zones D1, D2 and D3 is made of a magnetic material. Each first core portion annular plate element 15*a*1 takes the quite same configuration as each yoke portion annular plate element 15*b* inclusive of the embossed portions (T). Except that the inner diameter is that of the center hole 11*c*, each second core portion annular plate element 15*a*2 takes the same configuration as each first core potion annular plate element 15*a*1 inclusive of the embossed portions (T). Further, except that the outer diameter is that of the flange portion 1*d*, each third core portion annular plate element 15*a*3 takes the same configuration as each second core portion annular plate element 15*a*2 inclusive of the embossed portions (T). In the same manner as the yoke portion annular plate elements 15*b* and the non-magnetic annular plate elements 15*c*, the first through third core portion annular plate elements 15*a*1, 15*a*2, 15*a*3 are joined bodily in axial alignment each by being fit in another to be piled thereon at the embossed portions (T) thereof. The embossed portions (T) of the first core portion annular plate element 15*a*1 at an end in the zone (D1) and the embossed portions (T) of the non-magnetic portion annular plate element 15*c* at the facing side of the non-magnetic portion 14 are brought into fitting engagement, so that the core portion 12 and the non-magnetic portion 14 are joined bodily in axial alignment with each other.

As described above, the stator body 11 which is composed of the non-magnetic portion 14 and the core portion 12 and the yoke portion 13 serially arranged in axial alignment at the axial opposite ends of the non-magnetic portion 14 and which has the inner bore 11*a* and the center hole 11*c* is formed by piling up and bodily joining the plural annular plate elements 15*c*, 15*b* and 15*a*1 to 15*a*3 in axial alignment with one another. In this particular embodiment, in order to make the sliding movement of the plunger 17 smooth and to make the clearance relative to the plunger 17 minimum for stronger magnetic attraction force, the inner bore 11*a* and the outer surface of the stator body 11 formed in this way are finished and improved in precision. Either one or both of the internal surface of the inner bore 11*a* of the stator 11 and the outer or external surface of the plunger 17 are coated with a thin non-magnetic film (e.g., plating of a nickel-phosphorus film in the depth of 20 to 50 micrometers, painting or coating of a resin of Teflon® or the like), whereby it can be obviated that two magnetic bodies are directly contacted with each other thereby to impede the smooth relative sliding movement therebetween.

When electric current is applied to the electromagnetic coil 18 of the electromagnetic drive device 10, the stator body 11 is excited in proportion to the magnitude of the electric current applied thereto thereby to make the plunger 17 attracted toward the core portion 12, and thus, the spool 24 of the operating device 20 is moved against the resilient force of the spring (not shown), as depicted at the lower half in FIG. 1. With movement of the plunger 17, the rear end fluid chamber (A) varies in volume, and the oil around the solenoid-operated valve within an oil pan (not shown) containing the same is charged into the rear end fluid chamber (A) or discharged therefrom through the labyrinth supply/drain passage 23, the intermediate fluid chamber (C), the clearance between the center hole 11*c* and the rod portion 24*a*, the electromagnetic section fluid chamber (B), and the communication node 17*c*.

In the foregoing embodiment, the non-magnetic portion 14 between the core portion 12 and the yoke portion 13 each made of a magnetic material can be formed easily and completely by piling up or laminating the plural non-magnetic portion annular plate elements 15*c* made of a non-magnetic material between the plural core portion annular plate elements 15*a*1, 15*a*2 and 15*a*3 made of a magnetic material and the plural yoke portion annular plate elements 15*b* made of a magnetic material. Thus, the magnetic flux can be prevented from leaking from the yoke portion 13 directly to the core portion 12 without passing through the plunger 17, and it is ensured that the magnetic flux passes from the yoke portion 13 reliably through the plunger 17 to the core portion 12, as indicated by a loop line with arrow in FIG. 1. Therefore, it does not occur that such magnetic leakage causes the magnetic attraction force on the plunger 17 to be weakened. Further, the plural annular plate elements 15 (15*a*1, 15*a*2, 15*a*3, 15*b*, 15*c*) which constitute the stator body 11 of the electromagnetic drive device 10 can be obtained by being blanked out from a plate member on a press, so that the electromagnetic drive device 10 can be reduced in the manufacturing cost.

Also in the foregoing embodiment, the plural embossed portions (T) each of which is prominent at the side of the front surface (Ta) and hollow at the side of the reverse surface (Tb) are formed on the body portion (S) of each annular plate member 15, and the prominent front surface (Ta) of the embossed portion (T) on each annular plate element 15 is fit in the hollow reverse surface (Tb) of the embossed portion (T) on another annular plate element 15 to be piled thereon, and in this way, all the annular plate elements 15 are joined one after another. Thus, it becomes quite easer to join all the annular plate elements 15 bodily in axial alignment with one another. In addition, since the embossed portions (T) can be formed at the same time when each annular plate element 15 is formed by being blanked out on a press, the forming of the embossed portions (T) can be practiced without incurring a substantial extra cost, so that the manufacturing cost for the annular plate elements 15 does not increase.

Although in the foregoing embodiment, each embossed portion (T) is predetermined in width and arc in cross-section, it is not limited to the shape. Rather, each embossed portion (T) may take the cross-section of a shallow trapezoid or any arbitrary shape. Or, the embossed portion (T) may be formed by practicing half-blanking process at each designated positions on the body portion (S) of each annular plate member 15 with a round punch and a die with a die hole of the same diameter, and all the annular plate elements 15 may be joined by fitting the prominent front surfaces (Ta) of the embossed portions (T) of each annular plate element 15 in the corresponding hollow reverse surfaces (Tb) of the embossed portions (T) of another plate element 15 to be piled thereon.

Also in the aforementioned embodiment, the inner bore 11*a* of the stator body 11 constituted by joining the plural annular plate members 15 is finished thereby to smoothen the sliding movement of the plunger 17 in the inner bore 11*a*, and the clearance between the plunger 17 and the inner bore 11*a* is minimized to increase the magnetic attraction force, so that the performance of the electromagnetic drive device 10 can be enhanced, In this particular embodiment, since the half-blanking for the embossed portions (T) is carried out simultaneously of the punching-out of the body portion (S), high precision can be attained as to the relative position between the inner bore 11*a* and each of the embossed portions (T), and the internal surface of each annular plate element 15 which can be obtained by a punching-out operation on a press is kept at a certain degree of preciseness as a matter of course. Accordingly, the punched-out internal surfaces of the plural annular plate elements 15 which are joined at the embossed portions (T) thereof each fit in another have a high concentricity, and thus, a small allowance is sufficient for finishing the inner bore 11*a*, so that the machining cost for such finish process can be restrained from increasing.

Figure 6:
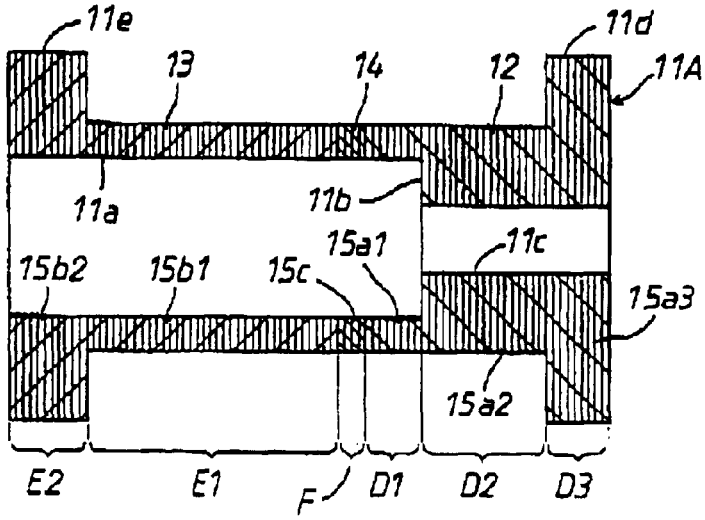
FIG. 6 is a sectional view of another stator body in the second embodiment used in place of that shown in FIG. 2.

Further, in the foregoing embodiment, the stator body 11 is provided with the flange portion 11*d* only at the forward end portion serving as the core portion 12. However, in the second embodiment, as shown in FIG. 6, there may be used another stator body 11A which is provided with another flange portion 11*a* also at the rear end portion serving as the yoke portion 13 in addition to the flange portion 11*d* provided at the forward end portion. Therefore, in the second embodiment, the yoke portion 13 is composed of two zones E1 and E2, and first yoke portion annular plate elements 15*b*1 in the zone E1 take the same configuration as the yoke portion annular plate elements 15*b* shown in FIG. 2, while second yoke portion annular plate elements 15*b*2 in the zone E2 take the same configuration as the third core portion annular plate elements 15*a*3 shown in FIG. 2 except for the difference in the diameter of the internal surface. Further, joining all the annular plate elements 15 at the embossed portions (T) thereof can be done in the same manner as those shown in FIG. 3 through 5. Since the laminated stator body 11A can be easily separated into two or more laminated blocks at any desired potions within any of the zones D1, D2, E1 and E2 by disengaging the embossed portions (T), any difficulty does not arise in assembling the electromagnetic coil 18.

Obviously, numerous modifications and variations of the present invention are possible in light of the above teachings. It is therefore to be understood that within the scope of the appended claims, the present invention may be practiced otherwise than as specifically described herein.

What is claimed is:

1. An electromagnetic drive device having a stator body composed of a core portion and a yoke portion serially arranged in axial alignment with a non-magnetic portion placed therebetween, a plunger slidably received in an inner bore formed in at least one of said yoke portion and said core portion in said stator body and resiliently urged in one direction, and an electromagnetic coil for exciting said stator body to move said plunger in the axial direction of the plunger against the resilient force, wherein said stator body is constituted by piling up in the axial direction and bodily joining a plurality of core portion annular plate elements made of a magnetic material to form said core portion, a plurality of yoke portion annular plate elements made of a magnetic material to form said yoke portion, and a plurality of non-magnetic portion annular plate elements made of a non-magnetic material to form said non-magnetic portion.

2. The electromagnetic drive device as set forth in claim 1, wherein:

each of said annular plate elements constituting said stator body is composed of an annular body portion and plural embossed portions each half-blanked from said annular body portion to be prominent at one surface side and hollow at the other surface side; and each of said annular plate elements is bodily joined with another annular plate element, with prominent portions of said embossed portions at one surface side of each annular plate element being fit respectively in hollow portions of said embossed portions at the other surface side of said another annular plate element.

3. The electromagnetic drive device as set forth in claim 1, wherein said inner bore of said stator body composed of said bodily joined annular plate elements has a modified finish.

4. The electromagnetic drive device as set forth in claim 2, wherein said inner bore of said stator body composed of said bodily joined annular plate elements has a modified finish.

5. The electromagnetic drive device as set forth in claim 2, wherein each of said embossed portions takes the form of an arc in section taken in the circumferential direction of each annular plate element.

* * * * *